United States Patent [19]

Thien et al.

[11] 4,186,693

[45] Feb. 5, 1980

[54] WATER-COOLED INTERNAL COMBUSTION ENGINE FOR MOTOR VEHICLES, PARTICULARLY A DIESEL ENGINE

[75] Inventors: Gerhard Thien; Heinz Fachbach, both of Graz, Austria

[73] Assignee: Hans List, Graz, Austria

[21] Appl. No.: 817,857

[22] Filed: Jul. 21, 1977

[30] Foreign Application Priority Data

Jul. 21, 1976 [AT] Austria ..... 5373/76

[51] Int. Cl.[2] ..... F01P 3/18; F01P 3/20; F01P 7/12

[52] U.S. Cl. ..... 123/41.12; 123/41.51; 165/41; 180/54 A; 180/68 R; 181/225

[58] Field of Search ..... 123/41.51, 41.11, 41.12, 123/41.05; 165/41; 180/54 A, 68 R; 181/283, 225, 204

[56] References Cited

U.S. PATENT DOCUMENTS

| | | | |
|---|---|---|---|
| 2,095,058 | 10/1937 | Cross | 123/41.51 |
| 2,177,686 | 10/1939 | Bracken et al. | 181/204 |
| 2,530,180 | 11/1950 | Russell | 123/41.11 |
| 2,729,203 | 1/1956 | Prendergast | 123/41.12 |
| 2,756,026 | 7/1956 | Myrent et al. | 165/41 |
| 3,093,983 | 6/1963 | Montgomerie | 123/41.12 |
| 3,601,100 | 8/1971 | Louckes | 123/41.51 |
| 3,774,710 | 11/1973 | Gustavsson | 123/41.51 |
| 3,964,449 | 6/1976 | Thien et al. | 123/41.51 |

FOREIGN PATENT DOCUMENTS

| | | | |
|---|---|---|---|
| 174819 | 10/1952 | Austria | 165/41 |

*Primary Examiner*—Charles J. Myhre
*Assistant Examiner*—Jeffrey L. Yates
*Attorney, Agent, or Firm*—Watson, Cole, Grindle & Watson

[57] ABSTRACT

A water-cooled internal combustion engine for motor vehicles, particularly a diesel engine, with a cooling system comprising two separate cooling units, each of them consisting of a radiator and a fan, the first cooling unit being arranged forwardly of the engine receiving drive from the engine by mechanical transmission means, the fan of the second cooling unit receiving drive from the engine itself via transmission means, the first cooling unit dissipating at least 60% of maximum heat output and the second unit coming into action additionally to the first by means of temperature control.

7 Claims, 1 Drawing Figure

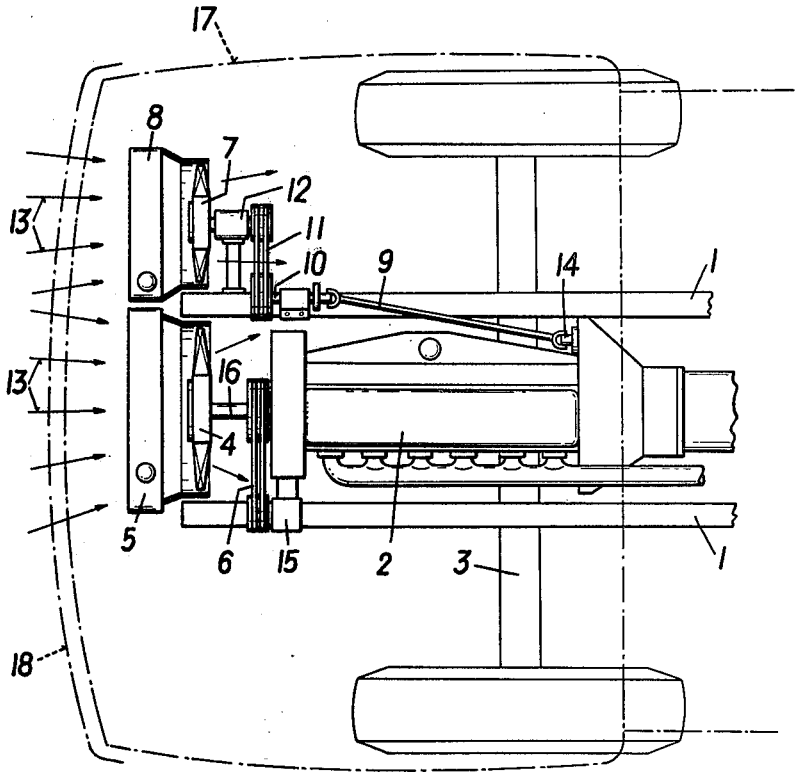
17
8
7
12
11
10
9
14
1
13
13
16
4
5
6
15
2
3
1
18

WATER-COOLED INTERNAL COMBUSTION ENGINE FOR MOTOR VEHICLES, PARTICULARLY A DIESEL ENGINE

BACKGROUND OF THE INVENTION

In the general effort to reduce noise emissions from motor vehicles important improvements have already been achieved with regard to reducing engine noise by encapsulating the engine. However, it is equally important to find a way of similarly reducing fan noise because, in the absence of noise-suppressing provisions for the engine, the fan produces noise at approximately the same level as the noise emanating from the engine itself.

Working on the premise that initially, i.e. without encapsulation, the engine is about equally as noisy as the fan, it would be desirable to reduce fan noise emission by 12 dBA because this is the value that noise emission from an engine can be reduced using an engine encapsulation. Thus, taking into consideration the fact that a noise reduction by 2 dBA may be achieved by carefully planned optimal fan design and correspondingly planned design of the fan bearings and mountings, this effectively leaves a further 10 dBA noise suppression to be achieved.

The present invention is based on the realisation that a reduction of noise output for a fan of this order of magnitude can be obtained by reducing the number of fan revolutions provided due provisions are made at the same time to ensure that under operative conditions, where a radiator-fan-cooling system of such reduced cooling capacity would be inadequate, it will be assisted and supported by a second radiator-fan-cooling system with a fan rotating at an equally low number of revolutions.

The noise output of a fan is approximately proportional to circumferential velocity to the power of five, and therefore, for a given diameter, also to revolution number to the power five. This means in the above-mentioned example that a noise reduction by 10 dBa would have to be achieved by a corresponding reduction of revolution numbers, which would amount to a fan speed of 63.3% of the original value. Correspondingly, the volume of cooling air output will be likewise reduced to 63.3% of the initial figure, and, since heat transfer decreases only at a rate which corresponds approximately to airflow velocity to the power of 0.8, the effective cooling performance would be reduced to approximately 69% of the original value.

Obviously the cooling systems for motor vehicles must be designed to cope with extreme conditions, that is to say, in the case of lorries, for operation with a full vehicle load at low road speed (uphill gradients) and with high outside temperatures. However, conditions in the overwhelming majority of over-land transport journeys will involve driving at fairly high road speeds where cooling air output of the fan is significantly assisted by the head-wind air-flow created when the vehicle is driven at a reasonably fast road speed. Moreover, in some geographical latitudes, extremely high outside air temperatures are liable to occur only for a very small percentage of the total number of days in the year. Consequently, for most of the time engine heat can be quite satisfactorily dissipated by a much more slowly rotating, and therefore far less noisy, cooling fan. Such a more slowly rotating fan has the added advantage of requiring about 25% less energy for its own drive. Fan-driving energy consumption is proportional to revolution number to the power of three, which means, as applied to the above-mentioned example, a reduction of $0.6333^3$ in fan-drive energy consumption, that is to say, of the order of approximately 0.25.

The present invention is based on the use of a conventional watercooled internal combustion engine for motor vehicles, and particularly for use on a diesel engine of the kind comprising a complete cooling system. Such a system usually comprises two separate radiator/fan cooling units for the coolant (water), one of the units being sited forwardly of the engine (looking in the direction of forward travel of the vehicle) and driven mechanically by the engine itself. In conventional arrangements of this type the second cooling unit usually comprises a fan which is driven by a separate electric motor. None of these existing arrangements either intend or indeed achieve a noise reduction for the first cooling unit. This applies, for example, to virtually all road vehicles with water-cooled engines which, in addition to the main cooling fan unit include a vehicle heating system with a heat exchanger and an electric fan. A suppression of fan noise is here neither achieved, nor even remotely contemplated. There are other existing arrangements, primarily applied to sports and racing cars, wherein the main radiator with its associated fan is accommodated in the engine compartment and an additional radiator and associated electric fan is provided elsewhere on the vehicle, and in which case the cooling system has been split up in this fashion purely for reasons of available space and by no means with a view to reducing noise emission. In sports or racing cars the cooling fan is designed on the principle of a maximum permissible output relative to useful engine output and in accordance with maximum permitted constructional size and weight specification. No consideration whatsoever is given to noise emission, which means that any experience gained in connection with sports or racing car construction is not likely to yield anything useful with regard to the reduction of fan noises in ordinary motor vehicles.

In the present invention the fan of the second cooling unit is also adapted to be driven by the engine of the vehicle by means of a mechanical or an hydraulic transmission, and the first cooling unit is arranged at the front of the engine, looking in the direction of forward vehicle travel, such that it will be capable, with maximum assistance from headwind airflow when driving at high spead, of evacuating at least 60% of maximum heat output by the engine. In addition, with a view to further increased engine heat output, the system is controlled in such a way that initially only the fan of the first cooling unit is operative whilst the fan of the second cooling unit comes automatically into action only when engine heat output exceeds the capacity of the first unit. It will be found that for most of the time the first cooling unit is perfectly adequate even though its cooling performance has been reduced, in the present example to approximately 69% of the original figure. Such a reduction corresponds to a reduction in noise emission from the fan which is approximately equal to the amount of engine noise suppression resulting from engine encapsulation.

Referring once more to the above example, this means that the second fan unit must be capable of dealing with only about 31% of the total amount of heat produced under extreme load conditions, which means in turn that this second unit may be of considerably smaller dimensions than the main or first unit and can therefore be easily accommodated and also that noise development can easily be kept within low and acceptable limits. Generally the fan of the first unit is driven by a V-belt drive. The fan of the second unit may also be driven by means of a V-belt, or, alternatively, by a cardan shaft, or by electric or hydrostatic transmission means. In most cases it will be possible to use the headwind air flow which is created when the vehicle is driven at fast road speed, to assist the cooling air output of the second fan unit as well as of the first or main unit.

In a further embodiment of the invention, the fan drives may be controlled in accordance with the temperature of either the cooling water in the cooling circuit or the cooling air, measured behind the radiator, looking in the direction of air flow, and in the case of a thermostatically regulated hydraulic control system, the fan of the second unit will be adapted to start operating at a slightly higher temperature than the fan of the first unit. This allows thermostatically controlled successive activation of the first and second cooling units because, as temperatures rise, the first thermostat will first switch on the fan of the first unit, and the fan of the second unit will be started up by the second thermostat only when the first unit is no longer capable of preventing a further increase in the temperature of the cooling water or air. Apart from the advantage of low noise emission, the arrangement according to this invention presents the further advantage of a maximum fuel saving because, basically, the cooling system will only require the precise amount of driving energy which is actually needed to evacuate, or dissipate, heat produced by the engine at any given time.

According to a further feature of this invention it is an advantage if at least one of the fans is controlled by means of a per se conventional, hydraulic or electromagnetic clutch coupling.

The invention will be hereinafter more specifically described with reference to a practical embodiment thereof shown in the accompanying drawing. This drawing is a diagrammatic top view illustration of the frontal part of a lorry with front wheel steering.

Referring to the drawing, the vehicle chassis is indicated at 1, the engine, which is mounted thereon in conventional manner, at 2, and the front axis of the lorry at 3. Forwards of the engine, looking in the direction of forward vehicle travel, there is arranged the fan 4 with thermostatically regulated hydraulic/revolution control means and the heat exchanger or radiator 5 is situated forwardly of the fan looking in the same direction of forward vehicle travel. Drive is transmitted to the fan 4 from the engine crankshaft (not shown) in per se conventional manner by means of the shaft 16 and V-belt drive 6, which also drives the dynamo 15. This cooling unit dissipates at least 60% of maximum heat production.

On the right hand side of this first cooling unit, viewing in the direction of forward vehicle travel, there is provided a second, smaller cooling unit comprising the fan 7 and the heat exchanger or radiator 8, the fan 7 also operating on thermostatically regulated hydraulic rev. control and receiving its drive from an auxiliary engine-take off 14 on the flywheel side through the cardan shaft 9, an intermediate shaft 10 mounted on the chassis 1 and an appropriate V-belt drive 11. The fan 7 is mounted on the chassis 1 by means of the fan bearing 12. The fans 4 and 7 of both units are provided with conventional, temperature responsive hydraulic control clutches, not shown in detail. The two heat exchangers or radiators 5 and 8 may be arranged in series or parallel with regard to water circulation. The necessary water pipes for this purpose have been omitted from the drawing for improved clarity of representation and likewise the connecting lines between the radiators and the engine cooling volume have also been omitted.

Both radiators or heat exchangers 5 and 8 are equally exposed to the headwind air stream indicated by arrows 13 which means that the amount of energy required to drive the fans 4 and 7 is reduced as well as the noise output.

The dot-and-dash lines in the drawing indicates the outlines of the driver's cabin 17 and of the front bumper 18 of the lorry to give a better idea of the actual position of the engine and its cooling system on the vehicle.

I claim:

1. An internal combustion engine with reduced noise level cooling system for a motor vehicle which comprises a water cooled internal combustion engine mounted on the frame of the motor vehicle, said engine having a drive shaft extending therethrough;

a first cooling unit mounted directly in front of said engine, said first cooling unit including a first radiator through which cooling water from said engine passes and a first fan mounted for rotation between said first radiator and said engine;

drive means mechanically connecting said first fan with said drive shaft so as to rotate same, said drive means including a first temperature-sensitive transmission device which allows said drive shaft to rotate said first fan when the cooling water flowing through said engine and said first cooling unit exceeds a first predetermined temperature;

a second cooling unit mounted adjacent said first cooling unit, said second cooling unit including a second radiator through which cooling water from said engine passes and a second fan, said second radiator and second fan having smaller dimensions than said first radiator and first fan, respectively; and auxiliary means mechanically connecting said second fan with said engine so as to rotate said second fan, said auxiliary means including a second temperature-sensitive transmission means which allows said engine to rotate said second fan only when a second predetermined temperature of said cooling water passing through said engine and said second cooling unit is exceeded, i.e., when said first cooling unit is inadequate to dissipate heat generated by said engine, said first cooling unit being capable of dissipating at least 60% of the maximum heat output of said engine.

2. The engine with cooling system of claim 1 wherein said drive means includes a V-shaped drive belt.

3. The engine with cooling system of claim 1 wherein said auxiliary means includes a cardan shaft, a V-shaped belt and an intermediate shaft connecting said cardan shaft with said V-shaped drive belt.

4. The engine with cooling system of claim 1 wherein said drive means includes a hydraulic coupling element.

5. The engine with cooling system of claim 1 wherein said drive means includes an electro-magnetic coupling element.

6. The engine with cooling system of claim 1 wherein said temperature-sensitive transmission device comprises a temperature responsive hydraulic control clutch.

7. The engine with cooling system of claim 1 wherein said temperature-sensitive transmission means comprises a temperature responsive hydraulic control clutch.

* * * * *